United States Patent [19]

Godfrey

[11] 4,072,834

[45] Feb. 7, 1978

[54] ELECTRIC SLIDE SWITCH HAVING SLIDING CONTACT WITH CLEANING ACTION

[75] Inventor: Nelson Frederick John Godfrey, Studham, England

[73] Assignee: ERG Industrial Corporation Limited, England

[21] Appl. No.: 702,151

[22] Filed: July 2, 1976

[30] Foreign Application Priority Data

Oct. 30, 1975 United Kingdom ..... 45038/75

[51] Int. Cl.[2] ..... H01H 1/60; H01H 15/02

[52] U.S. Cl. ..... 200/16 C; 200/164 R; 200/242; 200/253

[58] Field of Search ..... 200/115, 11 K, 16 R, 200/16 B, 16 C, 16 D, 153 L, 154, 164 R, 239, 241, 242, 245, 252, 253, 257, 275, 290, 67 A, 76, 77, 291

[56] References Cited

U.S. PATENT DOCUMENTS

| | | | |
|---|---|---|---|
| 2,246,373 | 6/1941 | Lodge | 200/164 R X |
| 2,550,145 | 4/1951 | Geci | 200/253 X |
| 2,666,101 | 1/1954 | Ellithorpe | 200/16 C |
| 2,966,560 | 12/1960 | Gluck | 200/16 C |
| 3,740,500 | 6/1973 | Garrett et al. | 200/257 X |
| 3,971,905 | 7/1976 | Delaage | 200/277 X |

FOREIGN PATENT DOCUMENTS

| | | | |
|---|---|---|---|
| 2,310,716 | 9/1974 | Germany | 200/16 C |
| 1,179,650 | 1/1970 | United Kingdom. | |

*Primary Examiner*—James R. Scott

*Attorney, Agent, or Firm*—Beveridge, De Grandi, Kline & Lunsford

[57] ABSTRACT

Miniature electrical switches having a sliding cleaning action, and utilizing a U-shaped bridging element with a detent projection for engagement in between and in contact with adjacent terminals and simultaneously providing electrical connection and detent action. The bridging element may have a curved bottom; it tilts backwardly as the bottom slides forwardly over a terminal, and subsequently is tilted forwardly by the recess trailing wall. An alternative element has a rounded off leading corner, rocks over a terminal, engages the adjacent terminal, and subsequently is tilted backwardly. The limiting position is unstable and the "on" position provides a cleaner interface.

7 Claims, 11 Drawing Figures

ELECTRIC SLIDE SWITCH HAVING SLIDING CONTACT WITH CLEANING ACTION

BACKGROUND OF THE INVENTION

This invention relates to electrical switches having spaced-apart fixed terminals and a movable bridging element arranged to make electrical connection between a corresponding pair of the fixed terminals, and is particularly, but not exclusively, applicable to miniature switches.

PRIOR ART

In known miniature electrical switches the movable element is in the form of a sliding element, or alternatively, a rolling element, and such elements are urged towards the fixed terminals under the action of a spring to provide contact pressure therebetween. In the latter case the rolling element, which can be cylindrical or ball shaped, rolls over the fixed terminals into its "on" position with substantially no sliding action and thus oxide films and other pollutants are retained in the interfaces between the rolling element and the fixed terminals and the contact depends for its effectiveness and reliability on the limited amount of force which can be exerted by the spring. In the former case, as shown in, for example, U.K. Patent Specification No. 1179650, it is known to use a sliding action to provide cleaning of the interfaces. However, a separate detent is used, which in the abovementioned specification is a spring-loaded ball carried by the slider and arranged to engage a corresponding depression or detent recess in the housing.

SUMMARY

According to the present invention there is provided an electrical switch in which the movable or bridging element is generally U-shaped and has a detent projection for removable engagement in between and in contact with adjacent terminals so as simultaneously to provide electrical connection and detent action. As the bridging element is pushed over a terminal it rotates in a first direction, the amount of tilt being determined by the leading wall of the recess. Further movement of the slider into its limiting position results in the element being rotated in the opposite direction to the extent determined by the slope of the trailing wall, and the detent projection sliding on the terminals to clean the interfaces. It will thus be seen that switches in accordance with this invention can be made more simply and cheaply than switches incorporating a separate detent, for example a ball and a corresponding depression into which it is loaded by an associated spring, and by virtue of the sliding action at the interfaces between the bridging element and the terminals can provide a lower resistance connection as compared with known switches with rolling bridging elements in which there is substantially no sliding action.

The terms "tilt forwardly" and "tilt backwardly" as used herein refer to the direction of a change of orientation of the bridging element, and are used in a relative sense as opposed to an absolute sense.

In one form of a switch in accordance with the present invention bridging element, has a curved, substantially arcuate bottom portion; also, the recess has a leading wall which is so arranged as to permit the bridging element to tilt backwards when, in use, it slides into said position in which it initially connects the terminals, and has a trailing wall which is so arranged that, when the slider is further moved to said limiting position, it acts upon the trailing arm of the bridging element to cause rotation of the bridging element while the curved bottom portion remains in contact with the terminals thus providing said sliding action of the bridging element against the terminals.

As used herein the terms "leading" and "trailing" relate to motion towards the "on" state or condition of the switch, i.e. movement towards the second terminal. It will be understood by those skilled in the art that the recess will be so positioned in the slider that the trailing edge does not push the bridging element away from the first terminal when the slider is moved into its limiting position.

In another form of such a switch the shaped bridging element has a flat bottom portion which joins the leading arm in a rounded off (preferably arcuate) leading corner and is a sufficiently loose fit within the recess so that when the slider is moved from an "off" position in response to an operating force applied thereto, the bridging element rocks about the first terminal and comes into contact with the second terminal at said leading corner, the region cleaned by said sliding action being within the leading corner. The bridging element is so shaped and arranged that when the slider is in said limiting position the spring means causes the bridging element to move towards the position of initial contact between the bridging element and the second terminal, thereby providing overrun cleaning of said interfaces.

A switch having only two spaced terminals has a simple on-off action. A change-over action can be obtained by the provision of a further terminal disposed as a mirror image of the second terminal with respect to the transverse plane through the first terminal. In such a changeover switch the bridging element and recess are preferably symmetrical about their respective transverse median planes.

It will be appreciated that in switches having a bridging element with a flat bottom portion the rocking and sliding action of the bridging element about the terminals provides a detent for the "on" position. This can be appreciated since after the bridging element rocks towards the non-contacted terminal there will be a resolved component of the reaction at the pivot on the contacted terminal which will act to push the bridging element towards the non-contacted terminal.

As mentioned, the bridging element may be shaped so that it can move back from its limiting position, due to a resolved component of the reaction at the leading portion. As the bridging element moves backwards it will change its angular position and as it does so the resolved component of the reaction at the contacted terminal will increase and oppose the backwards movement. The bridging element will come to rest with the contact position at the leading portion within the cleaned region. In practice, because of the various frictional forces involved, e.g. that between the slider and the housing, that between the bridging element and the slider, and that between the bridging elements and the fixed terminals, and because of the deflections of the upturned ends of the fixed terminals under the effect of the spring, the contact position will, as the bridging element backs from its limiting position under the effect of the spring, never reach the position of initial contact with the fixed terminal under normal environmental conditions i.e. in the absence of a force applied to the slider, and thus overrun cleaning of the interfaces is obtained since the contact point will always be within the cleaned region of the bridging element.

DETAILED DESCRIPTION

Figure 1:
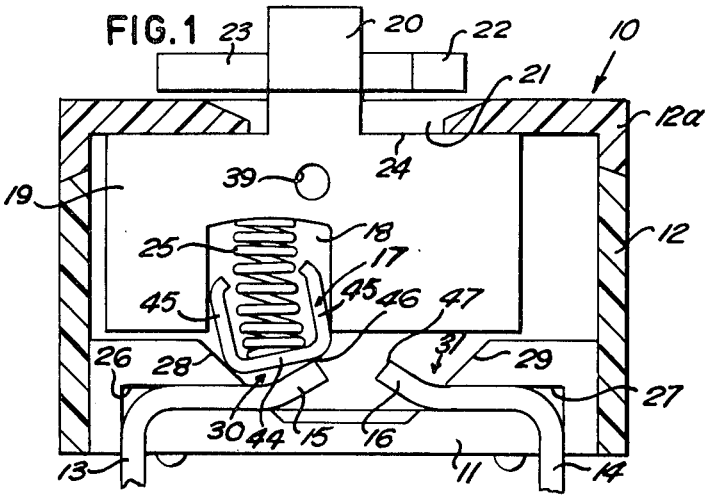
FIG. 1 is a sectional view through the slider and terminals of a slide switch showing a bridging element in a stable "off" position.

In FIG. 1 a miniature slide-action switch 10 having a simple "on-off" action comprises a housing formed of a base portion 11, which constitutes a wall of the housing in accordance with the present invention, and a cover portion 12, a pair of spaced-apart fixed terminals 13 and 14 secured in the base portion 11 and having upturned ends 15 and 16 for engagement with a bridging element 17 contained within a recess 18 in the lower surface of a switch operating member, or slider, 19 disposed within the switch. It will be understood that the terminals 13, 14 are upstanding for the purposes of the present invention. The terminals have leadouts projecting downwardly through the base portion 11. The leadouts are on 0.3 in centres. For ease of assembly, the upper portion 12a of the cover and the base portion 11 are together constituted by a single unit insertable into the remainder of the cover 12.

The slider 19 has an upwardly extending head portion 20 protruding through an elongate aperture 21 in the top of the cover portion 12. To assist identification of the desired movement for a given "on" or "off" condition of the switch, the head portion 20 has projecting portions 22 and 23 of which portion 22 is pointed and portion 23 has a flat, blunt free end. The portions 22 and 23 are integrally moulded with the remainder of slider 19 from a coloured plastics material. The cover portion 12 is formed of a plastics material having a contrasting colour to that of the slider 19. The switch is rendered "on" when the slider is pushed in the direction of the pointed portion 22 (see FIG. 5), and the pointed portion 22 is then seen in contrast to the underlying top surface of the cover portion 12. This indicates that the switch is in the "on" condition. To put the switch into an "off" condition, the slider is moved in the opposite direction, i.e. in the direction of the blunt portion 23. The "off" condition is shown in FIG. 1 where substantially the whole of the pointed portion 22 lies over a part of the elongate aperture 21 and is seen, not against a contrasting colour as in FIG. 5, but against the same colour, i.e. the upper surface 24 of slider 19, and thus this position of the slider is readily distinguished from its "on" position.

The bridging element 17 is formed from sheet material, and has a U-shaped cross-sectional configuration comprising two arms 45 jointed by a flat bottom portion 44. A helical spring 25, disposed within bridging element 17 and abutting the blind end of recess 18, acts to urge the bridging element 17 towards the terminals 13 and 14 which are secured within respective channels 26, 27 in the base portion 11 by force-fit. The upturned ends 15 and 16 of the terminals form, with associated respective inclined faces 28, 29 of the base portion 11, V-shaped recesses 30, 31 which cooperate with the bridging element 17 in a manner to be described later to provide a detent, for the "off" position of the bridging element.

Figure 2:
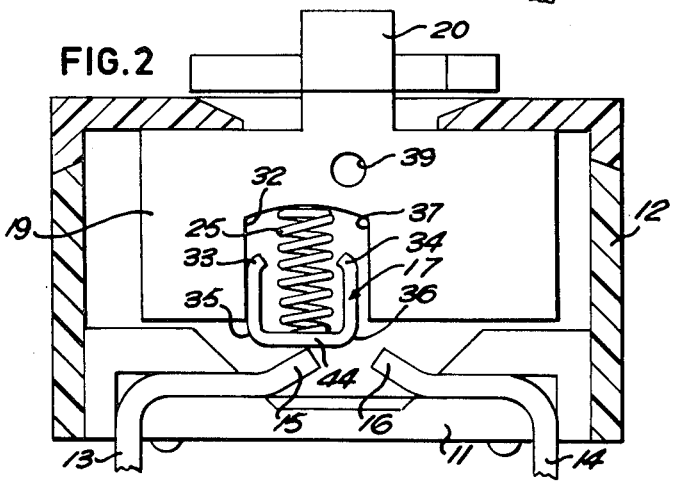
FIGS. 2 to 5 are similar views showing progressive positions of the bridging element up to a stable "on" position.
Figure 3:
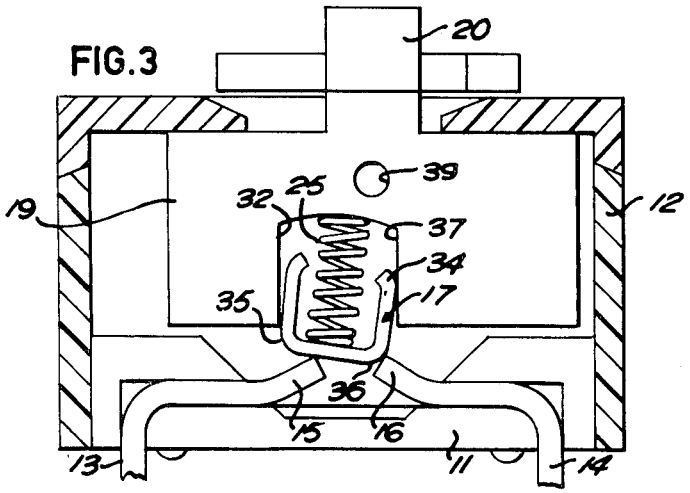
Figure 4:
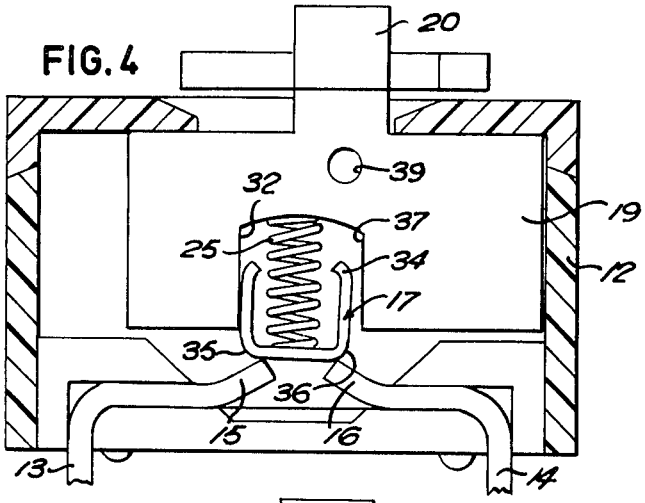
Figure 5:
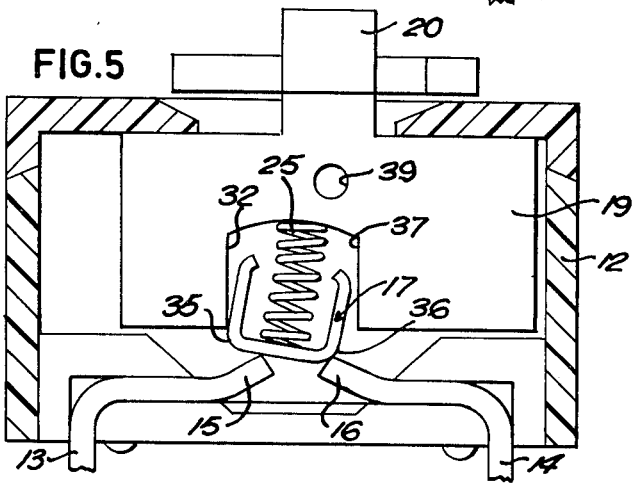

As mentioned, the slider 19 is in the "off" position in FIG. 1, and when the projecting head portion 20 is subjected to an operating force directed from left to right in the Figure the slider moves to the right passing in turn through each of the positions shown in FIGS. 2 to 4, and finally ending in the detented "on" position shown in FIG. 5.

In FIG. 2 the bridging element 17 has been pushed by wall 32 of the recess 18 and has scraped across the contact edge 46 of the upturned end 15 with consequential compression of spring 25. The bridging element 17 is a loose fit within the recess 18, the clearance being such as to permit a certain degree of rotation of the bridging element as it passes over the terminal ends 15, 16 without being so much as to risk the bridging element becoming jammed in the recess. The bridging element has inwardly turned free ends 33, 34 and curved bottom corners 35, 36 (constituting respective arcuate trailing and leading corners of the bridging element) which inter alia ensure that there are no sharp edges capable of digging into wall 32 and facing wall 37 of the recess. The bridging element is shown in a position of unstable equilibrium i.e. as the slider 19 moves a fraction more to the right, the bridging element 17 will rotate clockwise under the force from spring 25, and the free end 34 of the bridging element will contact wall 37 of the recess. Upon further movement of the slider, due to the operating force and to the resolved component of the reaction at end 15, the contact position between end 15 and the bottom of the bridging element will move towards corner 35 with consequential elongation of spring 25 and eventually the bottom corner 36 will come into contact with the contact edge 47 of the upturned end 16 of terminal 14, as shown in FIG. 3.

Continued operating force on the slider 19 will drive it into the position shown in FIG. 4 wherein the slider abuts the inside wall of cover portion 12, and the bridging element has rotated a small amount anti-clockwise. Upturned end 15 has scraped along a further length of the bottom of the bridging element, and upturned end 16 has scraped a corresponding length around the bottom corner 36. Thus the rubbing action of the ends 15 and 16 on the bridging element sweeps off oxide films and pollutants over a preselected length of the surface of the bridging element. As will be seen by reference to FIGS. 3 and 4 the cleaned portion of bottom corner 36 is from a position adjacent the flat surface of the corresponding U-arm to a position adjacent the flat surface of the bottom of the bridging element. Thus the position shown in FIG. 4 is an unstable position and under action of spring 25, the bridging element will tend to rotate clockwise, pushing the slider towards the left. Because of the friction between the slider 19 and the cover portion 12, and between the bridging element and the walls 32 and 37, the bridging element will not re-attain the position shown in FIG. 3 but will only approach that position. Thus switch 10 posseses the features that the bridging element 17 slides over the terminal ends 15, 16 to effect cleaning of the interfaces, and that the bridging element 17 and spring 25 act together with the spaced ends 15, 16 as a detent to maintain connection between the bridging element 17 and the ends 15, 16. A further feature possessed by switch 10 is that in the final detented "on" position attained, i.e. the position shown in FIG. 5, both terminals ends 15 and 16 contact the bridging element at portions which have been rubbed clean by the overtravel or overrun of the slider when moving from the position shown in FIG. 3 to the limiting position shown in FIG. 4.

Figure 6:
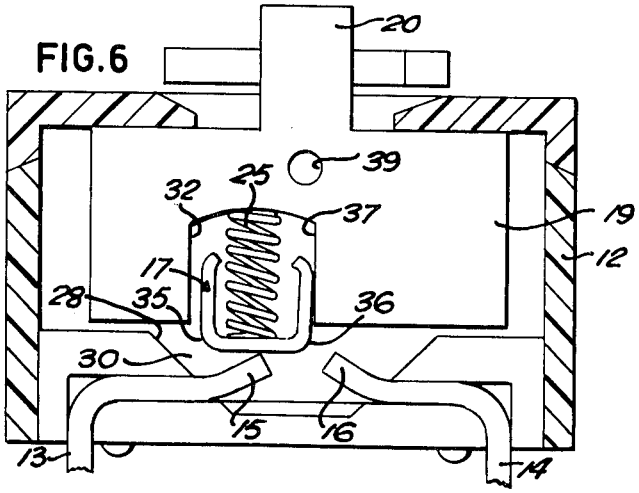
FIG. 6 is a similar view showing a position of the bridging element approaching the "off" position of FIG. 1 from the "on" position of FIG. 5.

To turn the switch off, an operating force directed from right to left is applied to the slider. Wall 37 of the recess 18 now contacts the bridging element and pushes it so that it rides up end 15 with consequential compression of spring 25. The bridging element then passes through the unstable position shown in FIG. 6, whereupon it begins to rotate anticlockwise under the action of spring 25 and eventually bottom corner 35 will contact the inclined face 28. Although overtravel of the slider to a limiting position wherein the slider contacts the inside wall of cover portion 12 will drive the bridging element up the inclined face 28, the action of spring 25 will return the bridging element, and the slider, to the final detented "off" position shown in FIG. 1. Alternatively, the slider can be of suitable length as to contact the housing in the "off" position of FIG. 1.

The spring 25 is a loose fit within the arms of the U-shaped bridging elements 17 and this gives rise to a certain amount of bowing of the spring as the bridging element rotates.

In the switch 10, a movement from left to right in the Figures puts the switch into its "on" condition. Because of the symmetry of the housing and terminals, the opposite action is obtained if the slider 19 is inserted in the housing after rotation through 180° about a vertical axis.

A plurality of switches 10 can be arranged side-by-side in common housing. An adjacent pair of switches can be ganged together via a pin inserted through hole 39 to provide double-pole switching or, if one of the sliders is "reversed" as just mentioned, a change-over action when terminal 13 of one of the pair of switches is connected externally to terminal 14 of the other switch of the pair.

Figure 7:
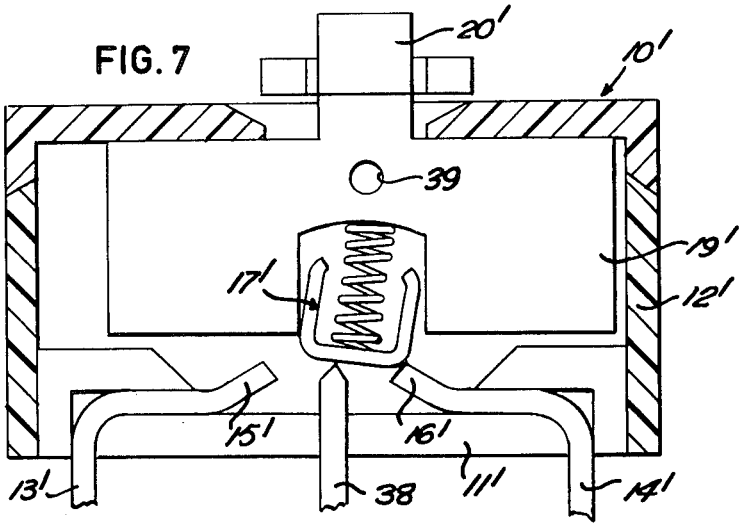
FIG. 7 is a sectional view through the slider and terminals of a three terminal change-over slide-action switch.

FIG. 7 shows a slide-action switch 10′ having a similar basic arrangement as the switch 10 but including a further upstanding fixed terminal 38 which is mounted centrally in a base portion 11′ of a housing of switch 10′. The distance between terminal 38 and each of the upturned ends 15′ and 16′ of the other terminals 13′ and 14′ of switch 10′ is equal to the distance between the upturned ends 15 and 16 of switch 10. Switch 10′ is thus a change-over switch with the bridging element 17′ movable by the slider 19′ either to the position shown in FIG. 7 where terminals 38 and 14′ are electrically connected, or to another position symmetrically disposed with respect to the centre terminal 38 wherein the bridging element electrically connects terminals 38 and 13′. It will be understood that an operator will push the slider head portion 20′ until the slider 19′ abuts the inside of cover portion 12′, in the same manner as for the switch 10, and that the cleaning of the contact areas of the bridging element 17′ will be identical to that described above for the switch 10.

It will thus be appreciated that each of the above described switches provides a cleaning action whereby in the "on" position the positions of contact between the terminals and the bridging element are within the regions cleaned when the slider is pushed beyond the detented "on" position into a limiting position and allowed to return under the action of the spring to the detented "on" position.

Figure 8:
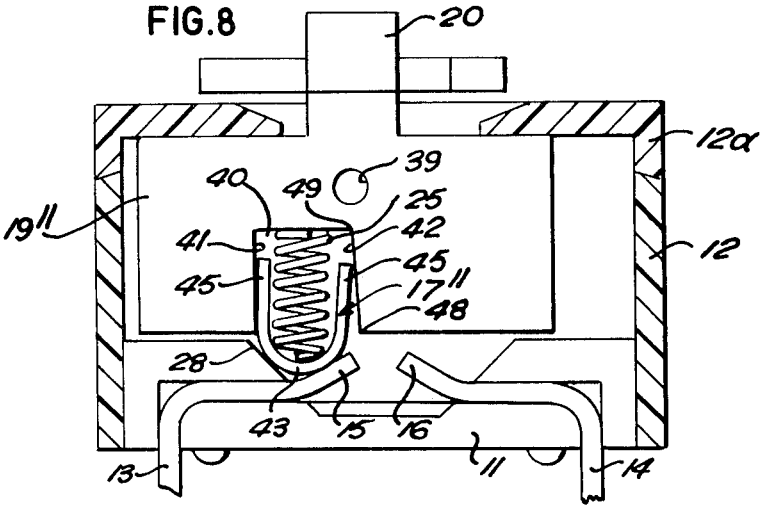
FIG. 8 is a sectional view through the slider and terminals of an alternative embodiment of a slide switch showing a bridging element in a stable "off" position.

In FIG. 8 there is shown a further alternative embodiment of a miniature slide-action switch which is generally of the same form as the switch 10 shown in FIG. 1, but which has a modified bridging element 17″ and a modified slider 19″.

The bridging element 17″ differs from the bridging element 17 of FIG. 1 in that the arms 45 are straight and not inwardly turned in the manner of the free ends 33 and 34 (FIG. 2), and also in that the bottom portion 43 of the bridging element 17″ is arcuate instead of having a bottom portion in the form of a straight portion 44 joining the curved bottom corners 35 and 36 (FIG. 2). In fact the arms are nominally very slightly splayed, but with manufacturing tolerances can be parallel.

The slider 19″ has a recess 40 in which the bridging element 17″ and a helical spring 25 are disposed. The recess has walls 41 and 42 which can conveniently be referred to as trailing and leading faces in relation to the direction in which the slider moves when the switch is brought into its "on" condition. Wall 41 corresponds to wall 32 of the switch 10 of FIG. 1 to 6 and its plane is at right angles to the direction of motion of the slider; wall 42 is similar to wall 37 of switch 10 but it is slightly inclined so as to be further from wall 41 at the open end of the recess 40 than at the blind end of the recess, in other words, its outer edge 48 is formed relative to its inner edge 49. The bridging element 17″ is dimensioned such as to be a clearance fit with walls 41 and 42 at the blind end of the recess.

FIG. 8 shows the switch at the position, during switching from "off" to "on", at which the bridging element 17″ is about to break contact with the inclined face 28 and slide up the upturned end 15 of terminal 13. The frictional force between the bridging element 17″ and the upturned end 15 causes the bridging element 17″ to turn clockwise, as seen in the drawings, until the free end of its leading arm comes into contact with inclned wall 42.

Figure 9:
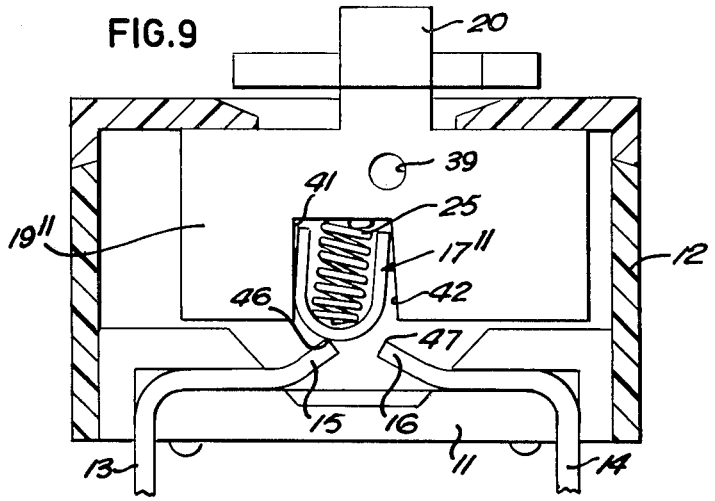
FIGS. 9 to 11 are similar views showing progressive positions of the bridging element up to a stable "on" position.

As the slider moves further to the right, as seen in the drawings, the bridging element rides up the upturned end 15 with consequential compression of spring 25 until a position of unstable equilibrium is reached generally as indicated in FIG. 9.

Figure 10:
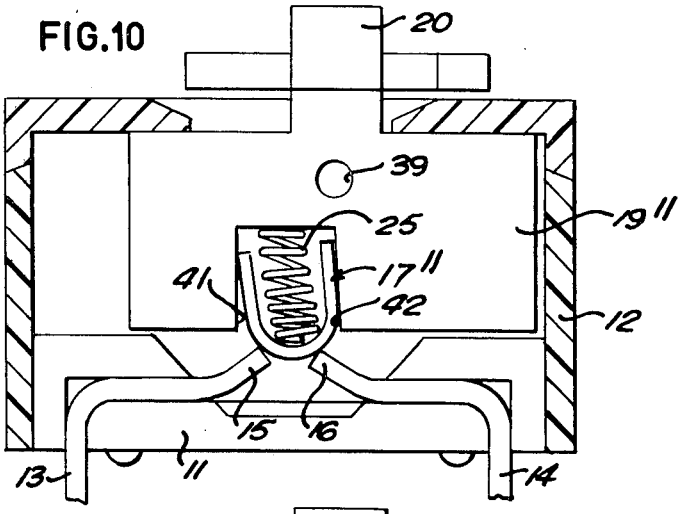
Figure 11:
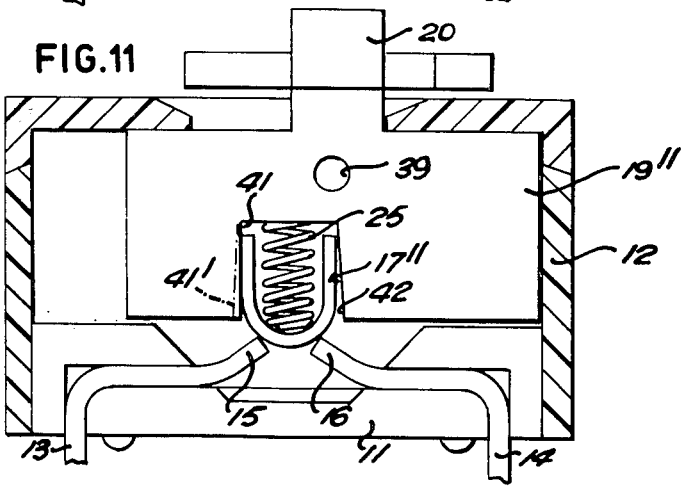

Upon further movement of the slider, the bottom of the bridging element 17″ slides on the contacting edge 15′, twisting anticlockwise, i.e. tilting backwardly, as permitted by the inclined wall 42, and the general position as shown in FIG. 10 is reached with the bottom of the bridging element 17″ also contacting contact edges 16′ of terminal 14. The dimensions of the slider and cover are preselected such that the position shown in FIG. 10 is reached just prior to the slider reaching its limiting position within the cover, as shown in FIG. 11. During this final part of the slider movement wall 41 acts on the free arm of the bridging element 17″ to cause it to tilt forwardly, i.e. to rotate clockwise, whereupon, under the force provided by the spring 25, the contacting edges of upturned ends 15 and 16 scrape against the curved bottom portion of the bridging element 17″. The final position as shown in FIG. 11 is the stable "on" position of the switch wherein the bridging element 17″ is upright and symmetrically positioned relative to the upturned ends 15 and 16. There is thus no resultant force on the bridging element or the slider and the position is one of stable equilibrium. Tests on prototype switches of the type shown in FIGS. 8 to 11 indicate that a very satisfactory contact resistance is achieved, of the order of 10 milliohms, and that connection is made with no observable contact bounce.

As will be appreciated, the scraping only extends over a few tens of microns of the curved bottom portion of the bridging element, but this is sufficient to provide a cleaning action. In practice, the slider will be driven into its limiting position in contact with the inside of the cover, provided that an operator pushes the slider, conveniently by applying a force to the head portion 20, in the normal manner, that is until resistance to the motion is felt. Although the slider can be stopped when contact is made between the terminals and before the cleaning action takes place, the operating action required for this is totally unnatural, and thus in normal operation the connection between the terminals is made reliably with a scraping cleaning action at the regions of contact.

The abovedescribed slide-action switches all have a bridging element so designed and arranged that a scraping cleaning action accompanies the connection of the terminals via the bridging element. Furthermore, the switches all have detent action for their "off" and "on" positions which is provided by the cooperation of the bottom portion of the bridging element with the terminals for the "on" position, and with a respective inclined face 28 or 29 for the "off" position. This bottom position in effect constitutes a detent nose or projection which cooperates with a detent recess effectively provided by the spaced upstanding terminals.

In the switch shown in FIGS. 8 to 11, the spacing of the contact edges of the upturned ends 15 and 16 in the "off" condition of the switch is 1.22mm, the radius of the arcuate bottom portion of the bridging element 17″ is 1.66mm, and assuming a change in the spacing from 1.22 to1.17 when the switch is in its "on" condition due to the resilience of the upturned ends 15 and 16, the directions of the reactions at the ends 15 and 16 are approximately at right angles to each other.

If it is desired to make a three terminal changeover form of this latter type of switch corresponding to the changeover switch of FIG. 7, then the recess wall 41 can be made to correspond to wall 42, as shown by dashed line 41′ in FIG. 11, in order to obtain symmetrical operation for both directions of slider movement. This will permit a slightly greater forward tilting of the bridging element as compared with the amount of tilt for the position shown in FIG. 9. The leading portion of the slider can be reduced in length, with corresponding lengthening of the aperture 21, to enable a slightly longer travel of the slider which will result in a tilting forwards of the bridging element as its trailing arm becomes approximately parallel to the inclined trailing wall of the recess.

Whereas in the embodiment of FIGS. 8 to 11 the bridging element tilts backwardly, as in FIG. 10, and is restored to an upright position, as in FIG. 11, if desired, the leading and trailing walls 42, 41 respectively, can be interchanged. In this case, the bridging element will adopt an upright position when it meets contacting edge 16′, this being determined by the upright leading wall, and it will then tilt forwardly as determined by the inclined trailing wall, when the slider moves into its limiting position. However, the arrangement shown in FIGS. 8 to 11 is preferred since in the limiting position shown in FIG. 11 the longitudinal axis of the spring 25 is at right angles to the direction of motion of the slider and the contact forces at the interfaces are thus nominally equal.

I claim:

1. An electrical switch comprising a housing, at least first and second upstanding spaced-apart fixed terminals mounted in a wall of the housing, a slider disposed within the housing for movement along the direction joining the terminals and having a blind recess in a surface of the slider adjacent the terminals, a bridging element of U-shaped cross-section having a pair of arms joined by a curved bottom, the bridging element being disposed within the recess with its curved bottom projecting out of the recess towards the terminals, a helical spring disposed between the arms of the bridging element and acting between the inside of said curved bottom of the bridging element and the blind end of the recess to urge the curved bottom into contact with the terminals, the recess having a first wall which, when an operating force is applied to the slider, pushes the bridging element so that it slides over said first terminal, the recess also having a second wall facing said first wall of the recess and being so disposed as to permit the curved bottom to slip forwardly over said first terminal under the action of said spring and engage removably between said first and second terminals, the slider being movable a further amount up to a limiting position, and when the slider is so moved in operation of the switch, said first wall of the recess pushes on the adjacent arm of the bridging element whereby the bridging element tilts forwardly through an angle, determined by the slope and disposition of said first wall, while the curved bottom remains in contact with and slides backwardly relative to said terminals resulting in a cleaning of the contact interfaces, and wherein said curved bottom of the bridging element constitutes a detent projection for removable engagement between said first and second terminals to provide a detent action for the switch.

2. An electrical switch according to claim 1 wherein said first wall of the recess is inclined forwardly relative to the sliding direction and is so disposed that when the slider is in said limiting position the trailing arm of the bridging element is substantially parallel to said first wall of the recess.

3. An electrical switch comprising a housing, at least first and second upstanding spaced-apart fixed terminals mounted in a wall of the housing, a bridging element of generally U-shaped configuration and being formed with a detent projection for removable engagement in between the terminals, said removable engagement of the bridging element in between the terminals simultaneously providing the electrical connection and a detent action for the switch, a slider disposed within the housing for movement in the direction joining the terminals and having a recess so adapted and disposed that when the slider is moved to a respective limiting position it pushes the bridging element over the first terminal towards the second terminal to connect the terminals, via the detent projection which engages both terminals and is disposed in between them, the bridging element tilts a predetermined amount in a first direction as it comes into contact with the second terminal, the terminals become connected before the slider reaches said limiting position, and the slider in the latter part of its movement continues to push the bridging element which is adapted such that it now tilts a predetermined amount in the opposite direction and the detent projection correspondingly slides on the terminals thereby cleaning the interfaces by this sliding action and the spring means for urging the bridging element towards the terminals.

4. An electrical switch according to claim 3 wherein the base of the U-shaped bridging element is of substantially arcuate shape, and wherein the recess includes a pair of walls which are respectively leading and trailing relative to the direction from said first terminal to said second terminal, said trailing wall being forwardly inclined relative to said direction from said first terminal to said second terminal, said first direction of tilt of the bridging element being backwardly, said opposite direction of tilt of the bridging element being forwardly, and said trailing wall pushing on the trailing arm of the bridging element, when the slider is moved to said limiting position, and causing the bridging element to lean forwardly to an extent determined by the slope of the inclined trailing wall.

5. An electrical switch according to claim 4 wherein the recess is symmetrical about a transverse plane of the slider whereby leading and trailing of the recess are further apart at the open end of the recess than at the blind end of the recess and act to define respective limits for the amounts of tilting of the bridging element.

6. An electrical switch according to claim 3 wherein the bridging element has a flat bottom, at least the leading corner of the bridging element relative to the directon from said first terminal to said second terminal being rounded off, said flat bottom and said leading corner together constituting said detent projection, the bridging element being a sufficiently loose fit within the recess that, in use, the bridging element rocks about said first terminal to come into contact with said second terminal at said leading corner whereby said first direction of tilt of the bridging element is forwardly, and wherein the slider and the bridging element are so arranged that when the slider is in said respective limiting position the bridging element has tilted backwardly said predetermined amount and is an unstable orientation, and the spring means causes the bridging element to tilt forwardly, when an applied operating force is removed, towards the position of initial contact between the bridging element and said second terminal, thereby providing overrun cleaning of said interfaces.

7. An electrical switch according to claim 2 wherein the recess is symmetrical about a transverse plane of the slider.

* * * * *